US005255012A

United States Patent [19]

Amano

[11] Patent Number: 5,255,012

[45] Date of Patent: Oct. 19, 1993

[54] THERMAL TRANSFER PRINTER

[75] Inventor: Toshio Amano, Kyoto, Japan

[73] Assignee: Rohm Co., Ltd., Kyoto, Japan

[21] Appl. No.: 925,215

[22] Filed: Aug. 6, 1992

[30] Foreign Application Priority Data

Sep. 6, 1991 [JP] Japan ..... 3-227431

[51] Int. Cl.[5] ..... B42J 2/32

[52] U.S. Cl. ..... 346/76 PH; 400/120; 346/134

[58] Field of Search ..... 346/76 PH, 134; 400/120; 271/277

[56] References Cited

FOREIGN PATENT DOCUMENTS 0055192 3/1987 Japan ..... 346/76 PH

OTHER PUBLICATIONS

"Photo Industry (Imaging Part 2)," Jul. 20, 1988, pp. 74–79 (Japanese journal article).

*Primary Examiner*—Benjamin R. Fuller
*Assistant Examiner*—Huan Tran
*Attorney, Agent, or Firm*—William H. Eilberg

[57] ABSTRACT

A thermal transfer printer comprises a flat tray supported to reciprocate between an advancing limit position and a retreating limit position with a sheet placed thereon, a ribbon supply device arranged above the tray for supplying a transfer ink ribbon, a heating print head, and a moving device for supporting the print head above the tray. The moving device causes the print head to move toward the tray for pressing the ink ribbon against the sheet when the tray moves toward the advancing limit position. Further, the moving device further causes the print head to move away from the tray when the tray moves toward the retreating limit position.

9 Claims, 8 Drawing Sheets

THERMAL TRANSFER PRINTER

BACKGROUND OF THE INVENTION

1. Field of the Invention

This invention relates generally to printers. More specifically, the present invention relates to a thermal transfer printer which is suitably usable for printing, on an image print sheet, an image displayed on a color CRT.

2. Description of the Prior Art

Nowadays, video recorders and video players are wide-spread and used for preparing software images (moving images). Indeed, these devices are increasingly displacing cameras which are used for preparing hardware images (still images) on image print sheets.

However, it is often convenient or preferable to prepare both software and hardware images. For this purpose, it has been proposed to print out, on an image print sheet, an image displayed on a CRT connected to a video player. One typical method serving this purpose is to use a combination of a thermal head and an transfer ink ribbon, as disclosed for example in the Japanese journal entitled "Photo Industry (Imaging Part 2)" issued on Jul. 20, 1988.

For conveniently describing the prior art method disclosed in the Japanese journal, reference is now made to FIG. 16 of the accompanying drawings. As shown, the prior art method utilizes a rotary drum 1 for supporting an image print sheet A' against which a thermal head 4 presses a transfer ink ribbon B' fed from a supply reel 2 for winding up on a winding reel 3. The transfer ink ribbon typically carries a deposited layer of sublimation dye or colored meltable wax which is thermally transferred onto the sheet A' by the actuation of the thermal head, thereby printing an still image on the sheet.

The prior art shown in FIG. 16 is disadvantageous in the following points.

First, since the sheet A' is wound around the drum 1 and subjected to heat for printing, it will have a tendency to curl even after removal from the drum. Further, if the sheet A' comprises a relatively hard substrate made of resin for example, it cannot be wound on the drum. Moreover, if the sheet A' comprises a matrix of surface paper segments releasably attached to a substrate, the surface segments may be unexpectedly removed off the substrate at the time of winding the sheet around the drum or during the printing operation.

Secondly, since the sheet A' wound on the drum 1 provides an arcuate printing surface, it is difficult to insure uniform contact of the thermal head 4 with the sheet surface. If the thermal head is improperly arranged relative to the drum, uneven printing will result. On the other hand, it takes a lot of time and skill to properly arrange the thermal head relative to the drum.

SUMMARY OF THE INVENTION

It is, therefore, an object of the present invention to provide a thermal transfer printer which is capable of eliminating or reducing the above-mentioned problems of the prior art.

Another object of the present invention is to provide a thermal transfer printer wherein sheet loading and removal can be conveniently performed.

According to the present invention, there is provided a thermal transfer printer comprising: a main body; a tray supported by the main body to reciprocate between an advancing limit position and a retreating limit position, the tray having a substantially flat support surface for receiving an image print sheet, the tray being provided with a clamp means at one end closer to the advancing limit position for removably clamping one end of the sheet; a ribbon supply means carried by the main body above the tray for supplying a transfer ink ribbon; a heating print head for causing ink transfer from the ink ribbon onto the sheet; and a moving means carried by the main body for supporting the print head above the tray, the moving means causing the print head to move toward the tray for pressing the ink ribbon against the sheet when the tray moves toward the advancing limit position, the moving means further causing the print head to move away from the tray when the tray moves toward the retreating limit position.

With the arrangement described above, the image print sheet is supported on the flat support surface of the tray, so that the sheet will have no tendency to curl after removal thereof from the tray. Further, the sheet may comprise a relatively hard substrate. Alternatively, the sheet may comprise a matrix of surface paper segments releasably attached to a hard or soft substrate. Moreover, no strict requirements are called for in positionally adjusting the print head relative to the tray due to the surface flatness.

According to a preferred embodiment, the printer further comprises a positioning-lifting means for laterally adjusting the position of the sheet relative to the tray at the time of placing the sheet on the tray and for lifting up the sheet from the tray when the tray is moved toward the retreating position. Obviously, the positioning-lifting means facilitates loading and removal of the sheet relative to the tray.

Other objects, features and advantages of the present invention will become apparent from the following detailed description of the preferred embodiments given with reference to the accompanying drawings.

DETAILED DESCRIPTION OF THE PREFERRED EMBODIMENT

Referring now to FIGS. 1–4 of the accompanying drawings, a thermal transfer printer according to the present invention includes a box-like main body case 10 which has an opening 10*a* through which a tray 11 partially projects out. The tray 11 has a substantially horizontal support surface 11*a* for supporting an image print sheet A, and the underside of the tray is provided with pairs of guide rollers 12 which engage a pair of horizontal guide rails 13 fixed to the case 10 therein. Thus, the tray 11 is reciprocally movable horizontally along the guide rails 13. Such movement of the tray is imparted by a reciprocating mechanism (not shown) which includes a motor and a belt for example.

The image print sheet A may typically comprise a relatively hard substrate and a single surface layer which provides good ink deposition. Alternatively, the sheet may comprises a substrate and a matrix of surface paper segments which are leasably attached to the substrate.

Figure 1:
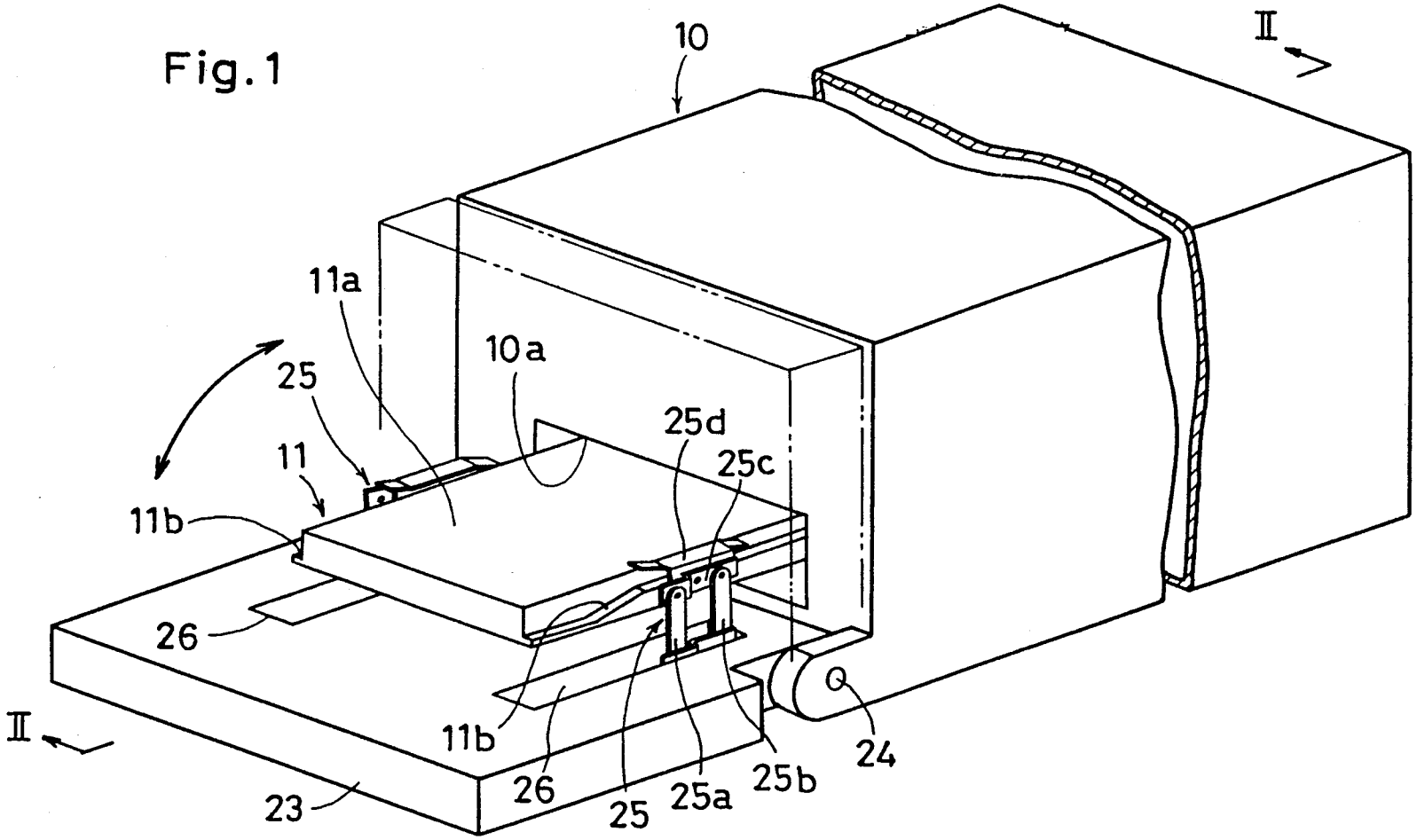
FIG. 1 is a perspective view showing a thermal transfer printer embodying the present invention.
Figure 2:
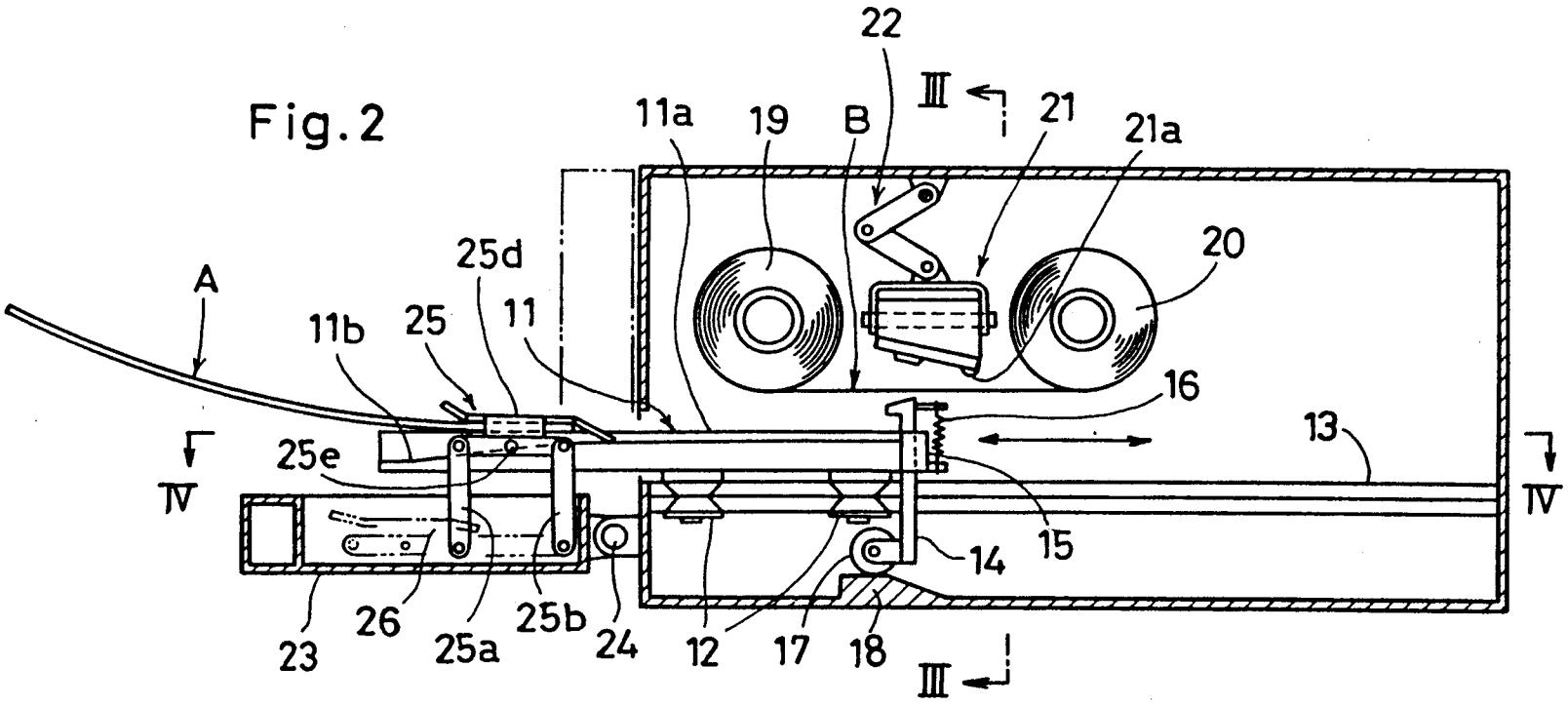
FIG. 2 is a sectional view taken along lines II—II in FIG. 1.
Figure 3:
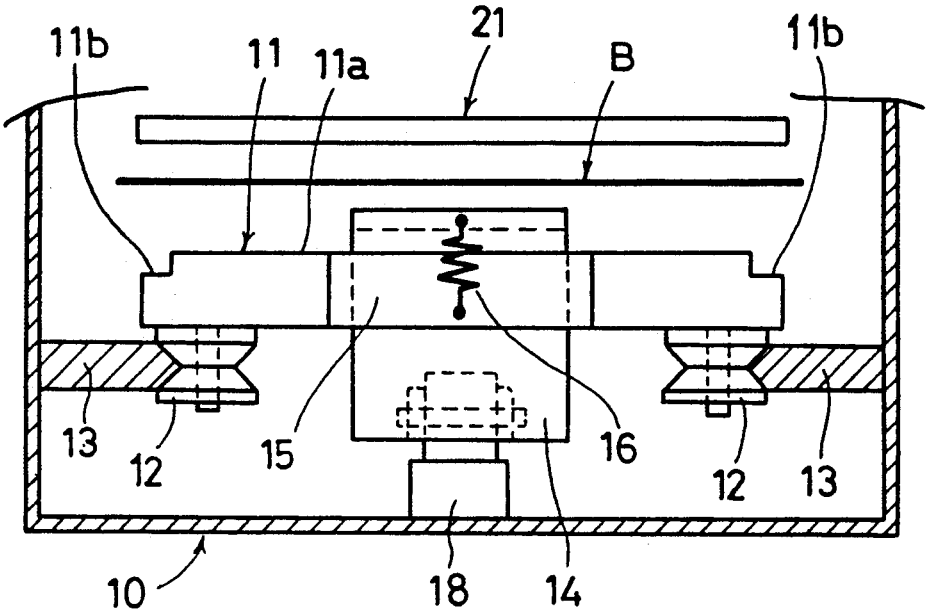
FIG. 3 is a sectional view taken along lines III—III in FIG. 2.
Figure 4:
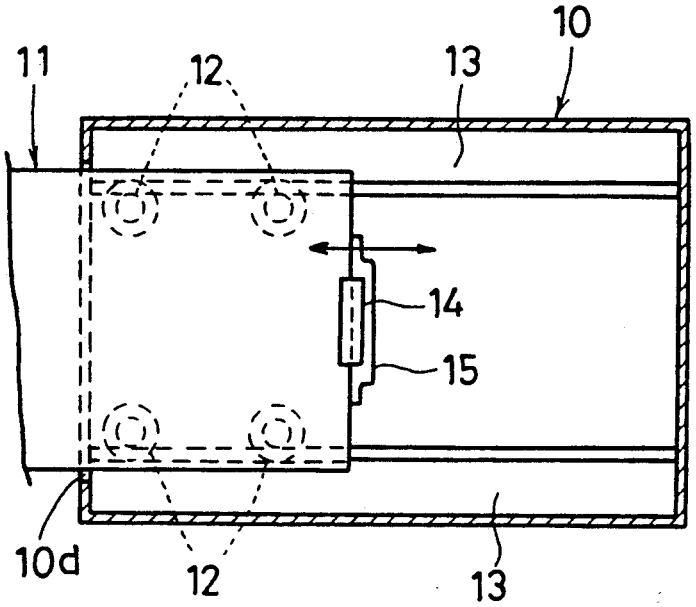
FIG. 4 is a sectional view taken along lines IV—IV in FIG. 2.

The tray 11 has a forward end (as viewed with respect to the advancing direction of the tray) provided with a clamp member 14 which is guided by a guide member 15 to move vertically, as shown in FIGS. 2–4. The clamp member 14 is always urged downward by a spring 16 interposed between the clamp member 14 and the guide member 15, thereby holding the forward edge of the image print sheet A between the clamp member 14 and the tray support surface 11*a*.

In the illustrated embodiment, the clamp member 14 has a lower end provided with a follower roller 17, and the bottom of the main body case 10 is provided with a cam projection 18 at a position corresponding to the retreating limit position of the tray 11, as shown in FIGS. 2 and 3. Thus, when the tray 11 reaches the retreating limit position, the follower roller 17 rides on the cam 18 to raise the clamp member 14 against the spring 16 (see FIG. 2), thereby releasing the sheet A.

As shown in FIG. 2, the main body case 10 accommodates a supply reel 19 for paying out a transfer ink ribbon B and a winding reel 20 for winding up the ribbon. The case further accommodates a thermal head 21 at a position between the respective reels 19, 20. The thermal head 21 has a downwardly directed line heater 20*a* (a line of heating dots) extending in parallel to the tray support surface 11*a* transversely of the moving direction of the tray 11. The thermal head 21 is mounted to the case 10 by means of a vertically moving mechanism 22 which includes links (or a cylinder) for example. Thus, the thermal head 21 is vertically movable relative to the ink ribbon B and the tray 11.

Though not illustrated, the respective reels 19, 20 may be housed in a single cartridge and mounted in the case 10 as a unit. The ink ribbon B may typically comprise an ink layer formed of sublimation dye or colored meltable wax.

In operation, when the tray 11 assumes its retreating limit position (FIGS. 1 and 2), the clamp member 14 is brought against the spring 16 to the raised position by the cam 18. In this condition, the image print sheet A is placed onto the tray support surface 11*a* until the forward edge of the sheet A comes into contact with the clamp member 14.

Figure 5:
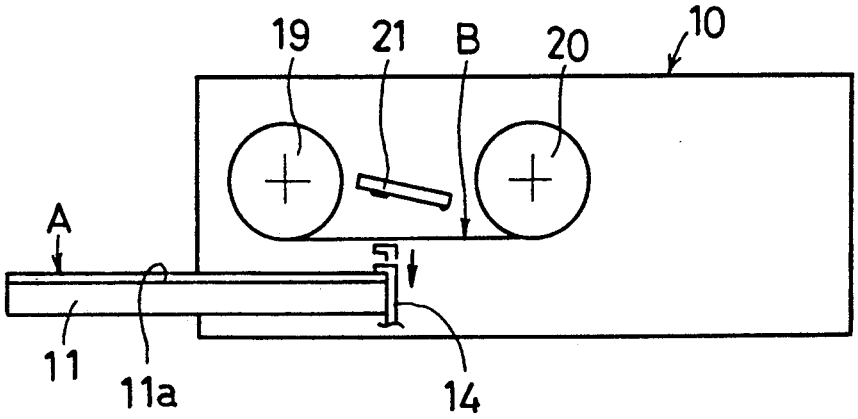
FIGS. 5 to 9 are schematic views illustrating successive stages of the printing operation.

When the tray 11 starts advancing, the follower roller 17 immediately goes down the cam 18. As a result, the clamp member 14 moves downward to hold the sheet A on the tray support surface 11*a*, as shown in FIG. 5.

Figure 6:
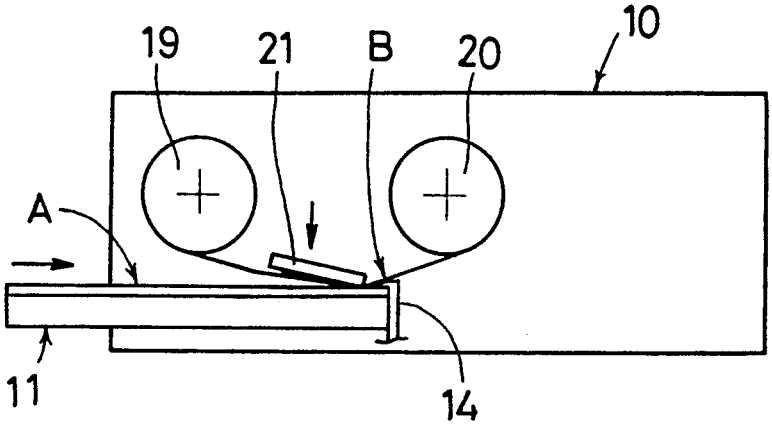
Figure 7:
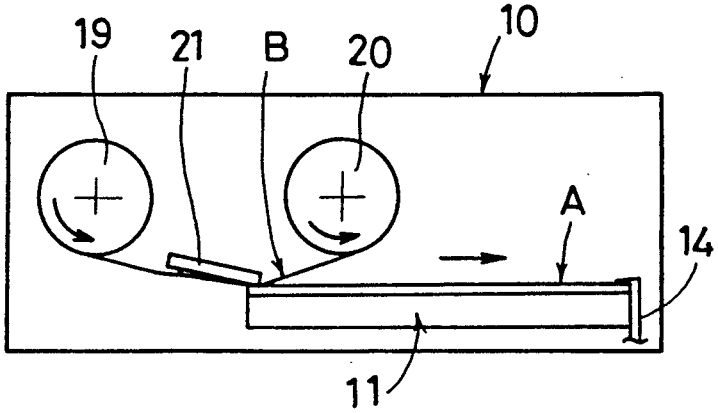

Subsequently, the thermal head 21 is moved downward by the vertically moving mechanism 22 (FIG. 2) to press the transfer ink ribbon B against the sheet A, as shown in FIG. 6. As a result, the thermal head 21 causes ink transfer to print a predetermined image onto the sheet A. This printing process continues until the tray 11 moves to the advancing limit position shown in FIG. 7.

Figure 8:
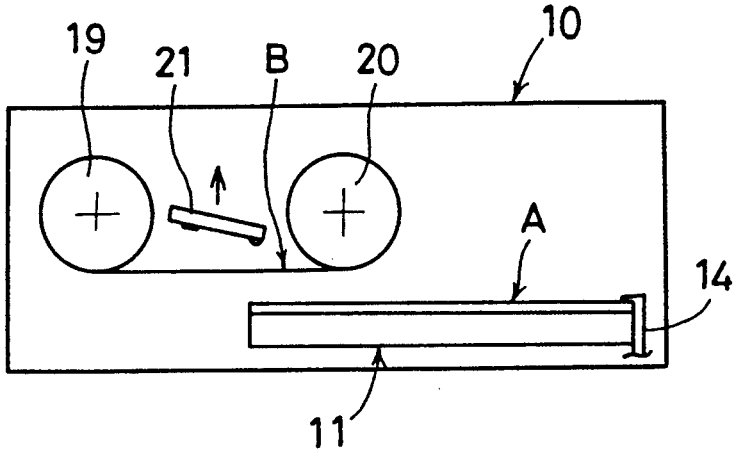
Figure 9:
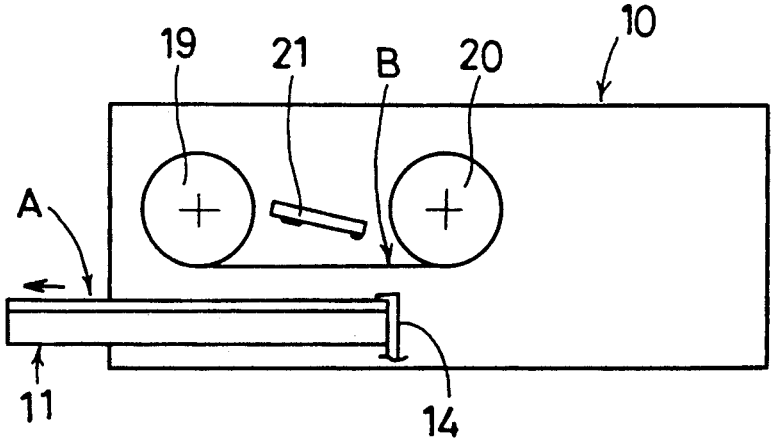

Upon completion of the printing process, the thermal head 21 is raised, as shown in FIG. 8. Then, the tray 11 is returned to the retreating limit position, as shown in FIG. 9. At this time, the clamp member 14 is raised to release the sheet A (see FIG. 2) for removal thereof from the tray 11.

Referring again to FIGS. 1 and 2, the main body case 10 is preferably provided with a door member 23 associated with the opening 10*a*. The door member 23 is pivotable about hinge pins 24 between an open position and a closed position. Further, the door member 23 carries a pair of positioning-lifting mechanisms 25 for laterally adjusting the position of the sheet A at the time of placing it and for lifting up the printed sheet at the time of removing it, as described below.

The respective positioning-lifting mechanisms 25 are arranged on both sides of the tray 11 and illustrated in FIGS. 1, 2 and 10–12. For mounting the respective positioning-lifting mechanisms 25, the door member 23 is provided with a pair of mounting grooves 26 which are upwardly open when the door member 23 is opened.

Each positioning-lifting mechanism 25 includes a parallel pair of pivotal links 25*a*, 25*b* having respective lower ends pivoted in the corresponding groove 26. The respective upper ends of the links 25*a*, 25*b* are pivoted to a connecting link 25*c* (see particularly FIGS. 10–12). Thus, the pivotal links 25*a*, 25*b* and the connecting link 25*c* provide a parallelogram linkage assembly which is always urged by an unillustrated spring to assume an upright position.

The connecting link 25*c* of the parallelogram linkage assembly pivotally supports an angular sheet guide 25*d* (having an inverted L-shape cross section) by means of a pin 25*e*. The sheet guide 25*d* has, at one end closer to the main body case 10, an integral follower tongue 25 inclining downward toward the case 10.

Figure 10:
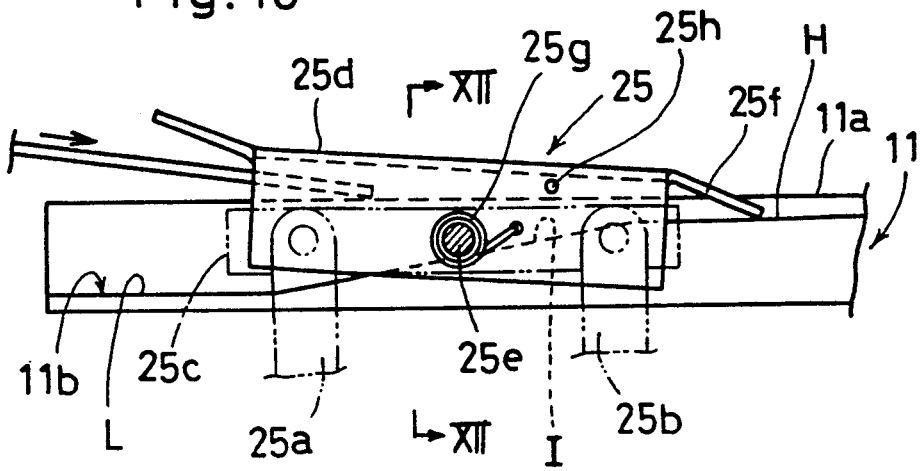
FIG. 10 is a side view showing a principal portion of a positioning-lifting mechanism.
Figure 11:
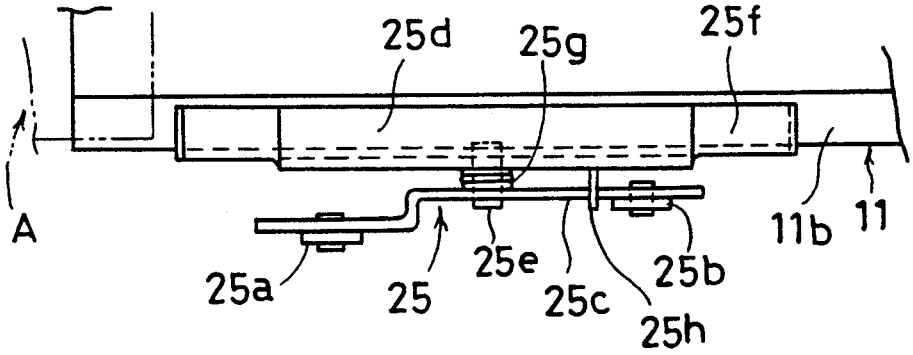
FIG. 11 is a plan view showing the same mechanism.
Figure 12:
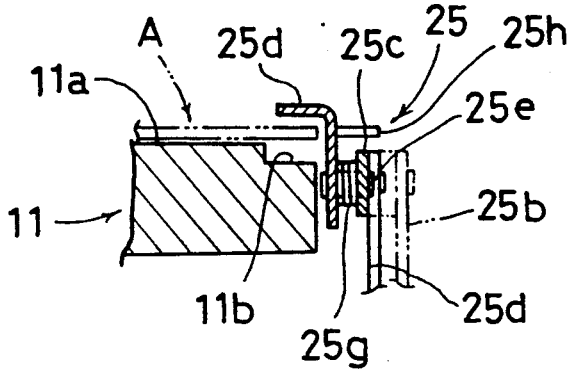
FIG. 12 is a sectional view taken along lines XII—XII in FIG. 10.

On the other hand, the tray 11 is formed, on each lateral edge thereof, with a cam track 11*b*. As shown in FIG. 10, this cam track includes a lower cam surface L located near the rear end of the tray, an intermediate inclined cam surface I following the lower cam surface, and a higher cam surface H forming the remainder of the cam track.

The sheet guide 25*d* of the positioning-lifting mechanism 25 is always urged by a torsion spring 25*g* in a direction tending to press the follower tongue 25*f* toward the cam track 11*b*. However, the pivotal movement of the sheet guide 25*d* in this direction is limited by a lateral stopper 25*h* which engages with the connecting link 25*c* from above.

In the illustrated embodiment, the positioning-lifting mechanism 25 is foldable into the corresponding groove 26. Specifically, when the door member 23 is pivoted upward for closing the opening 10*a* of the case 10, the sheet guide 25*d* comes into contact with the case. As a result, the positioning-lifting mechanism 25 is deformed against the unillustrated spring an entirely accommodated in the groove 26, as indicated by phantom lines in FIG. 2. Obviously, the positioning-lifting mechanism 25 automatically assumes its upright posture simply by pivotally opening the door member 23.

The positioning-lifting mechanisms 25 operates in the following manner at the time of placing and removing the image print sheet A.

Figure 13:
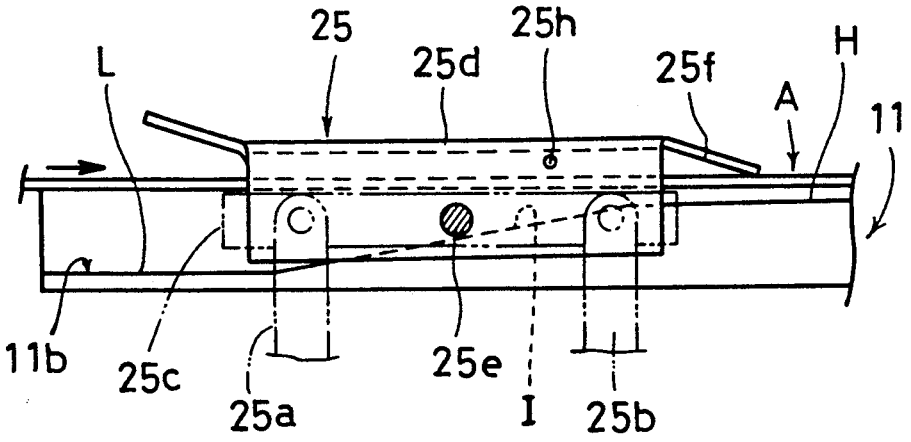
FIG. 13 is a side view similar to FIG. 10 but showing the same mechanism in its state immediately at the time of placing a sheet.

When the tray 11 assumes the retreating limit position, the follower tongue 25*f* of the sheet guide 25*d* is forced against the higher cam surface H by the action of the torsion spring 25*g*, as shown in FIG. 10. In this condition, the sheet A is introduced onto the tray support surface 11*a*. Obviously, the sheet guide 25*d* adjusts the lateral position of the sheet. At the same time, the sheet guide 25*d* is pivoted slightly upward against the torsion spring 25*g* to allow passage of the sheet A beyond the follower tongue 25*f*, as shown in FIG. 13. It should be appreciated that the sheet A is relatively hard (as already described), and the torsional spring 25*g* is not so strong as to cause unacceptable deformation of the sheet A at the longitudinal edges thereof.

Figure 14:
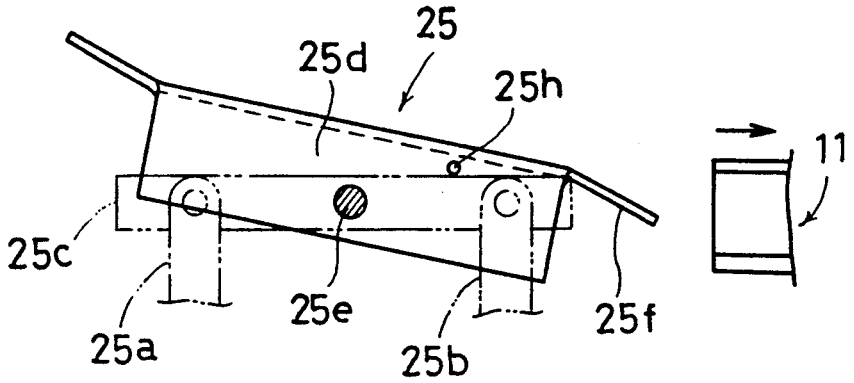
FIG. 14 is a side view also similar to FIG. 10 but showing the same mechanism in its standby state for lifting up the sheet.

When the tray 11 moves completely past the positioning-lifting mechanism 25, the sheet guide 25*d* is pivoted downward by the action of the torsion spring 25*g* until the lateral stopper 25*h* engages with the connecting link 25*c*, as shown in FIG. 14. In this condition, the follower tongue 25*f* is located below the sheet A.

Figure 15:
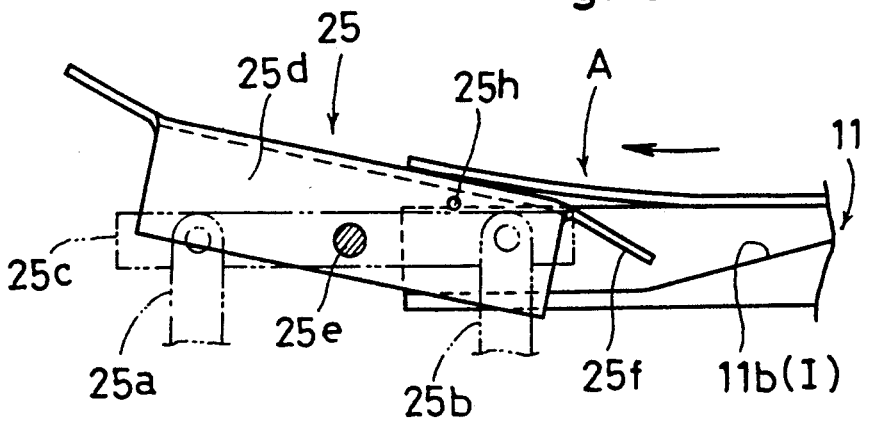
FIG. 15 is a side view again similar to FIG. 10 but showing the same mechanism at the time of lifting up the sheet.
Figure 16:
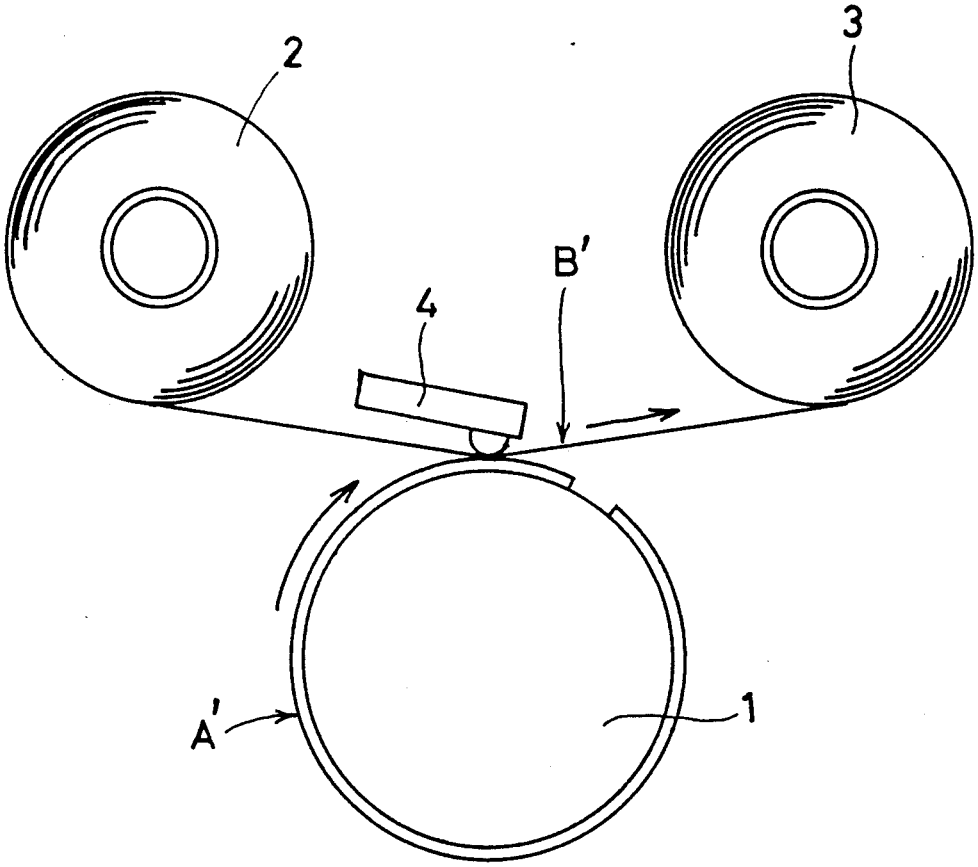
Fig.16 Prior Art
FIG. 16 is a schematic side view showing a prior art thermal transfer printer.

When the tray 11 is subsequently moved toward the retreating limit positioning after completion of the printing process, the sheet A rides on the downwardly pivoted sheet guide 25*d*, as shown in FIG. 15. Further, the follower tongue 25*f* climbs up the intermediate inclined cam surface I to pivotally raise the sheet guide 25*d*, thereby forcibly lifting up the printed sheet A from the tray 11.

In this way, the positioning-lifting mechanism 25 provides two different functions. First, it automatically adjusts the position of the sheet A laterally relative to the tray 11 (or the thermal heat 21), thereby facilitating proper placement of the sheet. Secondly, it lifts up the printed sheet A from the tray, thus facilitating sheet removal.

The present invention being thus described, it is obvious that the same may be varied in many ways. For instance, the main body 10 may be in the form of a frame without provision of the opening 10*a* and the door member 23. Such variations are not to be regarded as a departure from the spirit and scope of the invention, and all such modifications as would be obvious to those skilled in the art are intended to be included within the scope of the following claims.

We claim:

1. A thermal transfer printer comprising:

a main body;

a tray supported by the main body to reciprocate between an advancing limit position and a retreating limit position, the tray having a substantially flat support surface for receiving an image print sheet, the tray being provided with a clamp means at one end closer to the advancing limit position for removably clamping one end of the sheet;

a ribbon supply means carried by the main body above the tray for supplying a transfer ink ribbon;

a heating print head for causing ink transfer from the ink ribbon onto the sheet;

a moving means carried by the main body for supporting the print head above the tray, the moving means causing the print head to move toward the tray for pressing the ink ribbon against the sheet when the tray moves toward the advancing limit position, the moving means further causing the print head to move away form the tray when the tray moves toward the retreating limit position; and a positioning-lifting means for laterally adjusting a position of the sheet relative to the tray at the time of placing the sheet on the tray and for lifting up the sheet form the tray when the tray is moved toward the retreating limit position.

2. The printer according to claim 1, wherein the positioning-lifting means comprises a pair of sheet guides located on both sides of the tray, each of said sheet guides being pivotable between first and second positions and always spring-biased toward the first position, each of said sheet guides having a forward end which is located under the tray support surface when each of said sheet guides is pivoted to said first position but which si located above the tray support surface when each of said sheet guides is pivoted to said second position.

3. The printer according to claim 1, wherein the forward end of each of said sheet guides is provided by a follower tongue, the tray having a pair of side edges each formed with a cam track which includes an inclined cam surface for camming engagement with the follower tongue, the inclined am surface being progressively higher toward the clamp means.

4. The printer according to claim 1, wherein the main body is in a form of a case which accommodates the tray, the ribbon supply means, the print head and the moving means, the case having an opening through which the tray partially projects out in the retreating limit position, the opening being closable by a pivotal door member hinged to the case, the positioning-lifting means being mounted on the door member.

5. The printer according to claim 4, wherein the positioning-lifting means comprises a pair of linkage assemblies on both sides of the tray, each of said linkage assemblies being arranged at a mounting groove formed on the door member, each of said linkage assemblies being deformable to assume an operative position projecting out of the mounting groove and an inoperative position completely accommodated within the mounting groove.

6. The printer according to claim 5, wherein each of said linkage assemblies is always urged to assume the operative position but forcibly deformed to assume the inoperative position when the door member is closed.

7. The printer according to claim 5, wherein each of said linkage assemblies is parallelogrammic.

8. The printer according to claim 1, wherein the clamp means comprises a clamp member which is movable perpendicularly to the tray support surface between a clamping position and a releasing position, the clamp member being always spring-biased toward the clamping position but forcibly moved toward the releasing position when the tray is moved to the retreating limit position.

9. The printer according to claim 8, wherein the clamp member carries a follower roller, the main body being provided with a cam projection which interact with the follower roller for forcibly moving the clamp member toward the releasing position when the tray is moved to the retreating limit position.

* * * * *